US008356813B2

(12) United States Patent
Ohkubo

(10) Patent No.: US 8,356,813 B2
(45) Date of Patent: Jan. 22, 2013

(54) PAPER FEEDER ASSEMBLY FOR IMAGE FORMING APPARATUS, AND IMAGE FORMING APPARATUS INCORPORATING THE SAME

(75) Inventor: Yasuhide Ohkubo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/929,960

(22) Filed: Feb. 28, 2011

(65) Prior Publication Data

US 2011/0221126 A1 Sep. 15, 2011

(30) Foreign Application Priority Data

Mar. 12, 2010 (JP) ..... 2010-056795

(51) Int. Cl.
*B65H 5/02* (2006.01)

(52) U.S. Cl. ..... 271/273; 271/274; 399/331

(58) Field of Classification Search ..... 271/273, 271/274; 399/67, 331, 122, 332; 3/273, 3/274

See application file for complete search history.

(56) References Cited

U.S. PATENT DOCUMENTS 8,014,701 B2 * 9/2011 Nakura et al. ..... 399/121
2008/0304847 A1 * 12/2008 Hirano ..... 399/67
2011/0142496 A1 * 6/2011 Kameda ..... 399/122
2011/0236070 A1 * 9/2011 Mizuno et al. ..... 399/122

FOREIGN PATENT DOCUMENTS

JP 05072938 A * 3/1993
JP 05119660 A * 5/1993
JP 07028354 A * 1/1995
JP 2007271917 A 10/2007
JP 2009122562 A 6/2009

OTHER PUBLICATIONS

JP-2009122562-A (Abstract).
JP-2007271917-A (Abstract).

* cited by examiner

*Primary Examiner* — Jeremy R Severson
(74) *Attorney, Agent, or Firm* — Harness, Dickey & Pierce, P.L.C.

(57) ABSTRACT

A paper feeder assembly for an image forming apparatus is configured to sandwich a sheet of paper between a roller and an opposing pressing member and feed the sheet of paper by the roller being rotated. The paper feeder assembly includes a pressure variable member for varying pressurized contact force between the roller and the pressing member. In conjunction with ON/OFF action of a power supply switch provided in a main body of the image forming apparatus, the pressure variable member ensures pressurized contact force enough to fix an image when the power supply switch is turned on, whereas the pressure variable member operates to separate the roller and the pressing member from each other when the power supply switch is turned off.

20 Claims, 10 Drawing Sheets

PAPER FEEDER ASSEMBLY FOR IMAGE FORMING APPARATUS, AND IMAGE FORMING APPARATUS INCORPORATING THE SAME

CROSS-REFERENCE TO RELATED APPLICATIONS

The present application claims priority to and incorporates by reference the entire contents of Japanese Patent Application No. 2010-056795 filed in Japan on Mar. 12, 2010.

BACKGROUND OF THE INVENTION

1. Field of the Invention

The present invention relates to a paper feeder assembly for an image forming apparatus such as copying machines or printers, and to an image forming apparatus which incorporates the paper feeder assembly.

2. Description of the Related Art

Paper feeder assemblies for an image forming apparatus are generally configured to allow a roller, such as a rubber roller whose surface is formed of an elastic material, and a pressing member to sandwich a sheet of paper therebetween to rotate it, thereby feeding the sheet.

However, when such a roller of an elastic material is kept out of use for a long time, the roller is held in pressurized contact with the pressing member with the elastic material left in a deformed state. This may cause the elastic material to be permanently deformed. This problematic phenomenon can occur to any rollers depending on their conditions so long as they are made of an elastic material. In particular, the elastic material of a fixing unit is often designed to deform to a large extent. In addition, the roller in the fixing unit is repeatedly heated and cooled, and can be kept permanently deformed with a high possibility. When the deformation becomes permanent, the roller does not rotate smoothly, thereby raising several problems. For example, the deformation causes a change in paper feed speed only at the deformed portion and deterioration in image quality solely at the deformed portion. A variation in torque at the deformed portion can cause the drive portion or structured portion to vibrate, resulting in unusual noise being produced.

These problems were attempted to be solved by a mechanism for automatically varying the applied force of the roller and the pressing member using a pressing unit, a cam, and a drive unit for rotating the cam (for example, as suggested in Japanese Patent Application Laid-open No. 2007-271917). However, such a method requires a driving source for driving the cam and a mechanism for transmitting the drive power, leading to an increase in size and costs of the whole unit. Furthermore, this method requires electric power to relieve the applied force. This may cause the pressurized contact to remain unreleased when the user has cut off the power source before the image forming apparatus stops operating completely. This could lead to the aforementioned problems.

Another exemplary attempt for solving the aforementioned problems was to employ a pressurized-contact release mechanism as disclosed in Japanese Patent Application Laid-open No. 2009-122562. However, this mechanism should be manually operated. And, based on the common sense, it cannot be said that the user always operates this mechanism without fail before leaving the apparatus unused for a long period of time.

It is therefore an object of the present invention to provide a paper feeder assembly for an image forming apparatus which is capable of preventing the deformation of a roller made of an elastic material. It is another object of the invention to provide an image forming apparatus which incorporates this paper feeder assembly.

SUMMARY OF THE INVENTION

It is an object of the present invention to at least partially solve the problems in the conventional technology.

According to one aspect of the present invention, a paper feeder assembly for an image forming apparatus is configured to sandwich a sheet of paper between a roller and an opposing pressing member and feed the sheet of paper by the roller being rotated, and the paper feeder assembly includes a pressure variable member for varying pressurized contact force between the roller and the pressing member, wherein in conjunction with ON/OFF action of a power supply switch provided in a main body of the image forming apparatus, the pressure variable member ensures pressurized contact force enough to fix an image when the power supply switch is turned on, and the pressure variable member operates to separate the roller and the pressing member from each other when the power supply switch is turned off.

According to another aspect of the present invention, a paper feeder assembly for an image forming apparatus is configured to sandwich a sheet of paper between a roller and an opposing pressing member and feed the sheet of paper by the roller being rotated, and the paper feeder assembly includes a pressure variable member for varying pressurized contact force between the roller and the pressing member, wherein the pressure variable member is capable of varying pressure in conjunction with the action of a power supply switch provided in a main body of the image forming apparatus, and the power supply switch has at least one or more power supply OFF positions and power supply ON positions, allowing pressurized contact force to be adjusted in a plurality of steps depending on the respective switch positions.

According to still another aspect of the present invention, a fixing unit or an image forming apparatus includes the feeder assembly as described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention is directed to a paper feed section, such as a paper feeder assembly and a fixing unit, to be used in an image forming apparatus in which an image formed in an image forming section is transferred onto a sheet of paper and then the transferred image is fixed on the sheet by the fixing unit. The paper feed section may be configured to sandwich a sheet of paper between a roller and an opposing pressing member, apply a predetermined amount of heat and pressure to fix an image, and feed the sheet of paper by the roller being rotated. In this case, the pressurized contact force between the roller and the pressing member is changed with a pressure variable member, which works in a cooperative relationship with the OFF/ON action of the power supply switch of the image forming apparatus. More specifically, in a power supply ON state, the pressure variable member ensures the pressurized contact force necessary to fix the image, whereas in a power supply OFF state, it operates to separate the roller and the pressing member from each other. Furthermore, the power supply switch and the pressure variable member mechanically cooperate with each other, thereby ensuring a predetermined pressure in a power supply ON state and the disengagement of the roller in a power supply OFF state. It is thus possible to prevent permanent deformation in the long out-of-service state.

Furthermore, the present invention is configured to employ a simple structure without any driving source, thereby preventing increases in costs. The invention provides an extended range of applications, for example, improves image quality and serves for various transfer materials by not only preventing permanent deformation but also allowing for adjustment of applied force in a plurality of stages. As such, preventing permanent deformation as well as allowing the multi-stage adjustments of applied force make it possible to improve image quality and employ various transfer materials.

Furthermore, the present invention is intended to apply particularly to a fixing unit that may raise permanent deformation concerns. The invention can be effectively applied particularly to a fixing unit that may raise concerns about permanent deformation.

Figure 1:
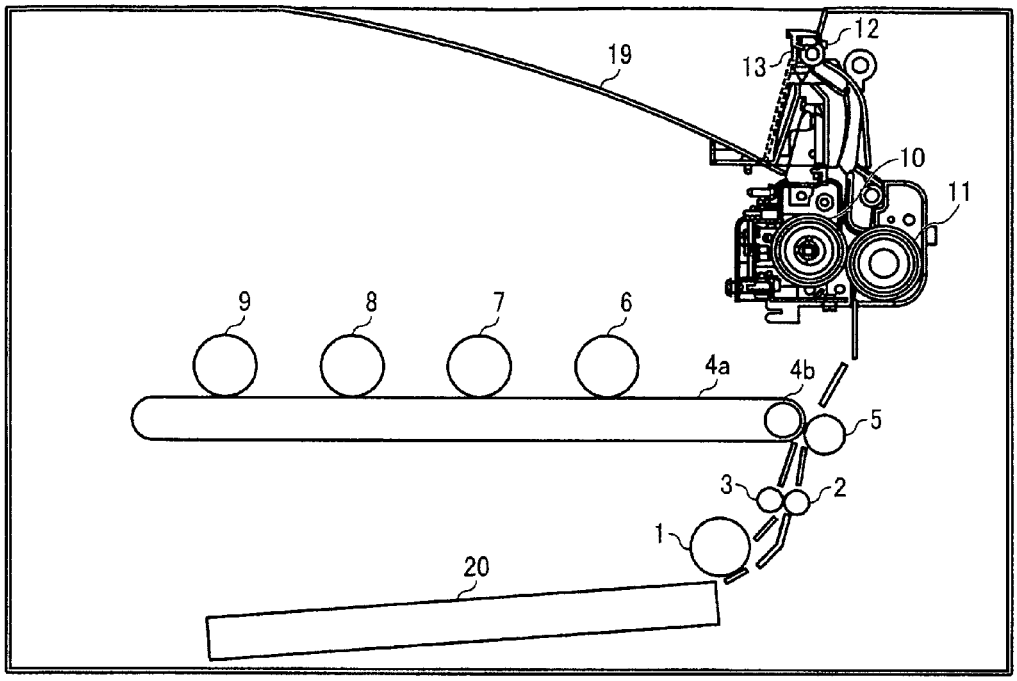
FIG. 1 is a center cross-sectional view illustrating an overall, exemplary image forming apparatus according to an embodiment of the present invention.

FIG. 1 is an overall view (cross-sectional view through the center) of an exemplary image forming apparatus according to an embodiment of the present invention. In FIG. 1, a feed path for sheets of paper is shown. One sheet of paper is separated from stacked sheets of paper 20 with a paper feeding roller 1 and reaches a transfer drive roller 4*b* and a driven roller 5 via a resist drive roller 2 and a driven roller 3. Then, the transfer drive roller 4*b* transfers, to the sheet of paper, an image that has been formed on an intermediate transfer belt 4*a* by photosensitive elements 6 to 9. The image is then fixed by heating, using a pair of fixing rollers (a fixing roller 10 and a pressing roller 11), onto the sheet of paper, which is then discharged by a pair of discharging rollers 12 and 13 into a discharge tray 19.

Figure 2:
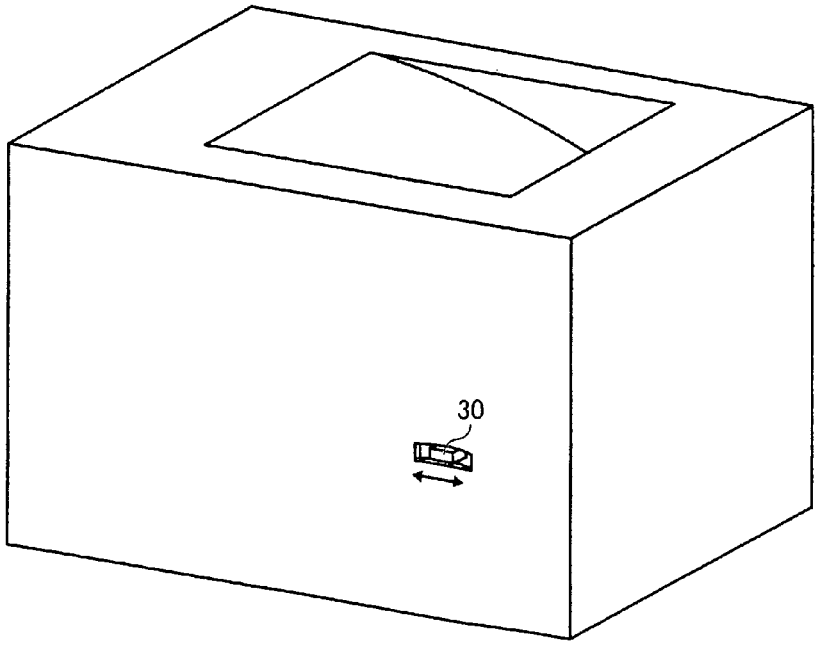
FIG. 2 is a perspective view illustrating the outer appearance of the main body of the image forming apparatus shown in FIG. 1.

FIG. 2 illustrates the outer appearance of the main body of the image forming apparatus shown in FIG. 1. As illustrated, part of the apparatus casing is cut away, so that a power supply switch 30 is exposed to the outside. The power supply switch 30 is guided by a component (not shown) of the main body so as to slide back and forth in the directions shown by the arrows in FIG. 2.

Figure 3:
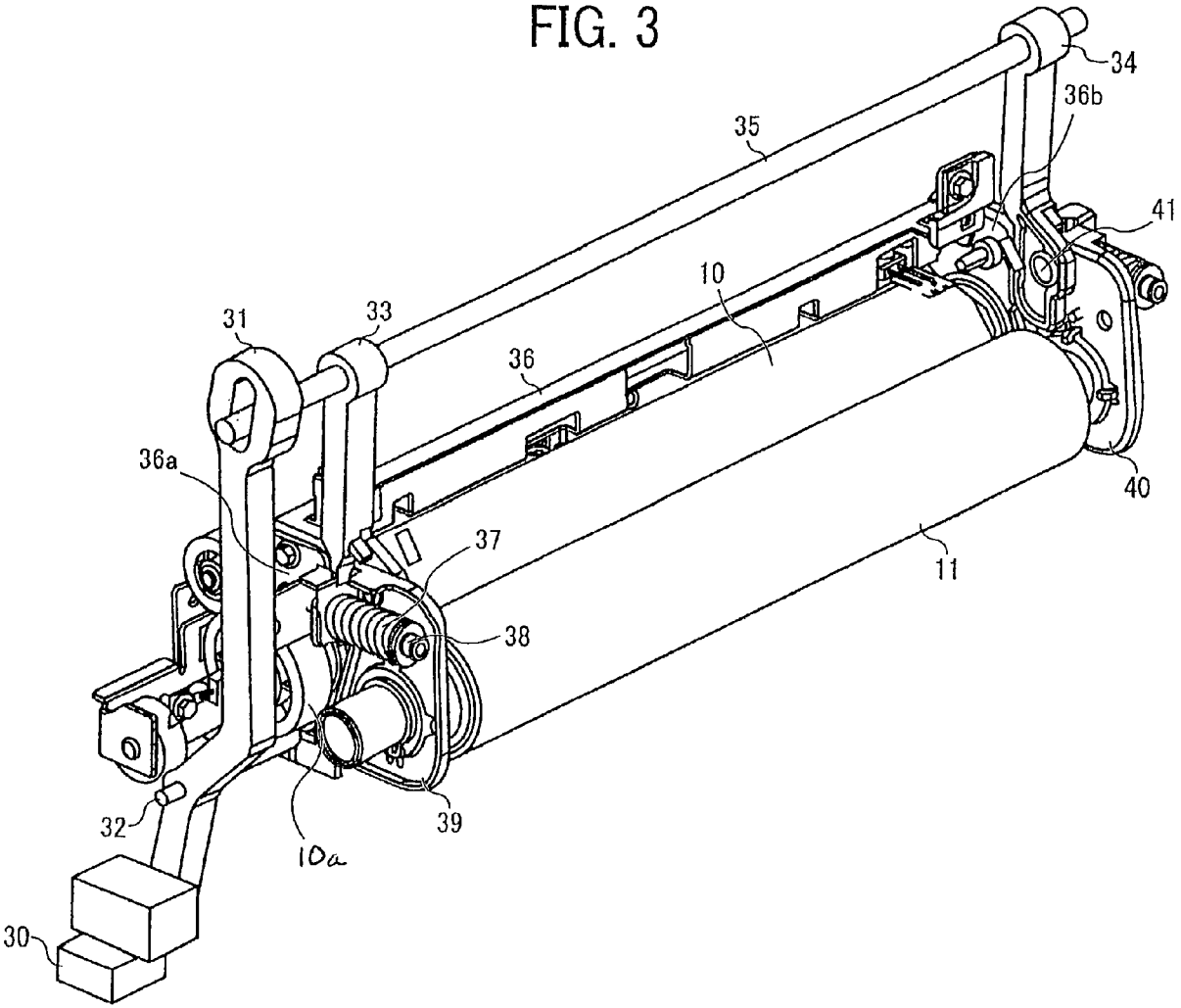
FIG. 3 is a perspective view illustrating a fixing unit.
Figure 4:
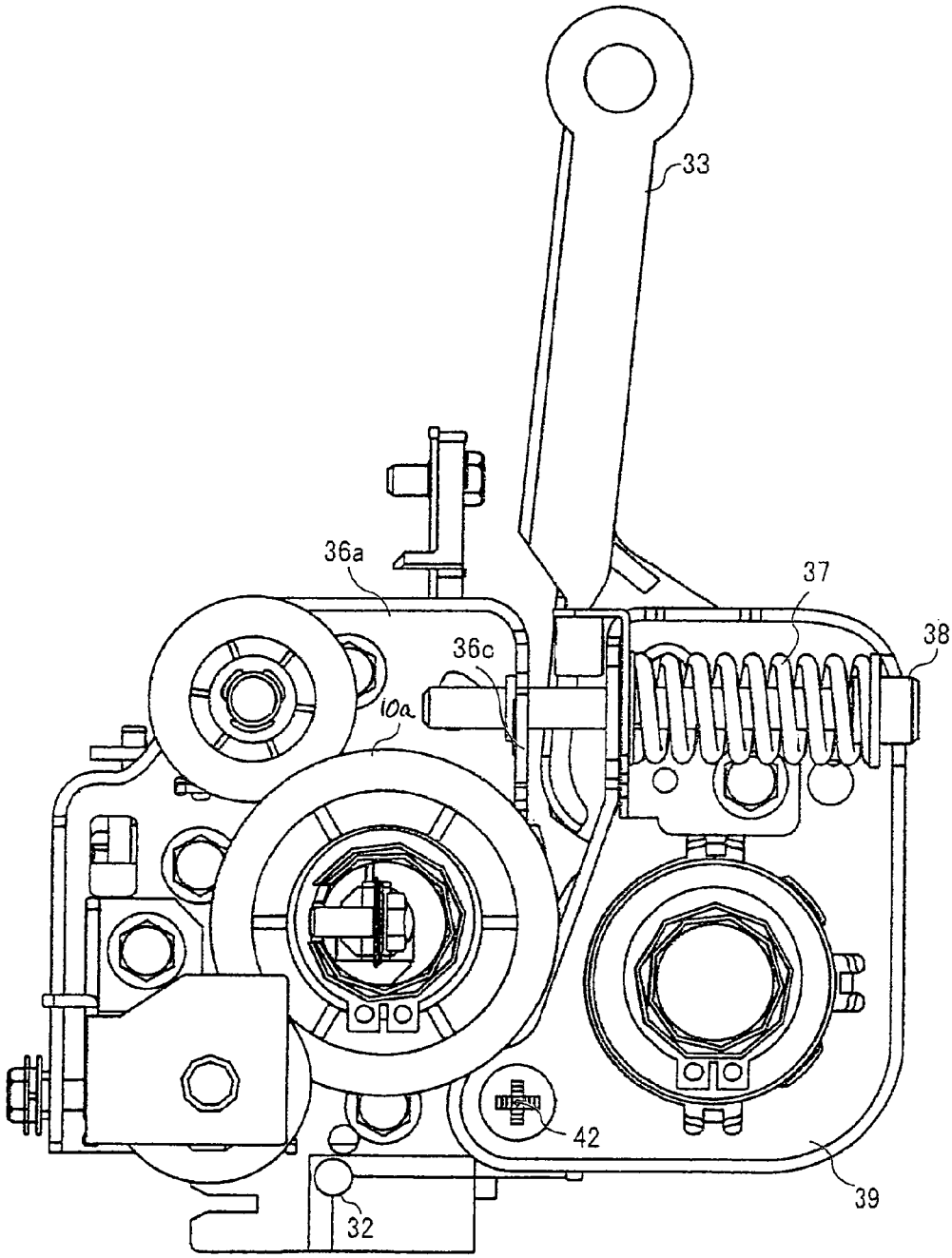
FIG. 4 is a side view illustrating the fixing unit.

FIG. 3 is a perspective view illustrating a fixing unit, and FIG. 4 is its side view. The fixing roller 10 is supported with bearings to be rotatable relative to fixing-roller side plates 36*a* and 36*b* that are integrated with a fixing unit frame 36. The fixing roller 10 is provided at its end portion with a gear 10*a* so as to be driven via a gear train from a driving source (not shown) in the image forming apparatus. The fixing roller 10 is provided therein with an infrared heater (not shown), which enables heating of a sheet of paper while the sheet is being fed.

This embodiment employs the pressing roller 11 as the pressing member. The pressing roller 11 is supported with bearings to be rotatable relative to pressing-member side plates 39 and 40. As shown in FIG. 4, these pressing-member side plates 39 and 40 are supported to be pivotable about a rotation fulcrum 42 provided on the fixing-roller side plates 36*a* and 36*b*. To apply pressure, there is disposed a compression spring 37 between the pressing-member side plate 39 and a screw 38, while the screw 38 is tightened into a screw hole 36*c* provided in the fixing-roller side plates 36*a* and 36*b*. The more the screw is driven, the more the compression spring is compressed. This causes the pressing-member side plates 39 and 40 to be pushed with greater force and the pressing roller 11 to be pushed indirectly against the fixing roller 10.

The fixing unit also has pressure variable members 33 and 34 which are supported to be pivotable about a rotation fulcrum 41 provided in the pressing-member side plates 39 and 40. The two right and left pressure variable members 33 and 34 are linked with a shaft 35, which is further connected to a link 31. The shaft 35 is connected to the link 31 via an elongated hole provided at one end of the link 31 in a manner such that the angle of the pressure variable members 33 and 34 determines the attitude of the link 31. The link 31 is also supported to be pivotable about a rotating shaft 32 provided in the fixing-roller side plates 36*a* and 36*b*, and the other end of the link 31 is fitted into the power supply switch 30.

Figure 11:
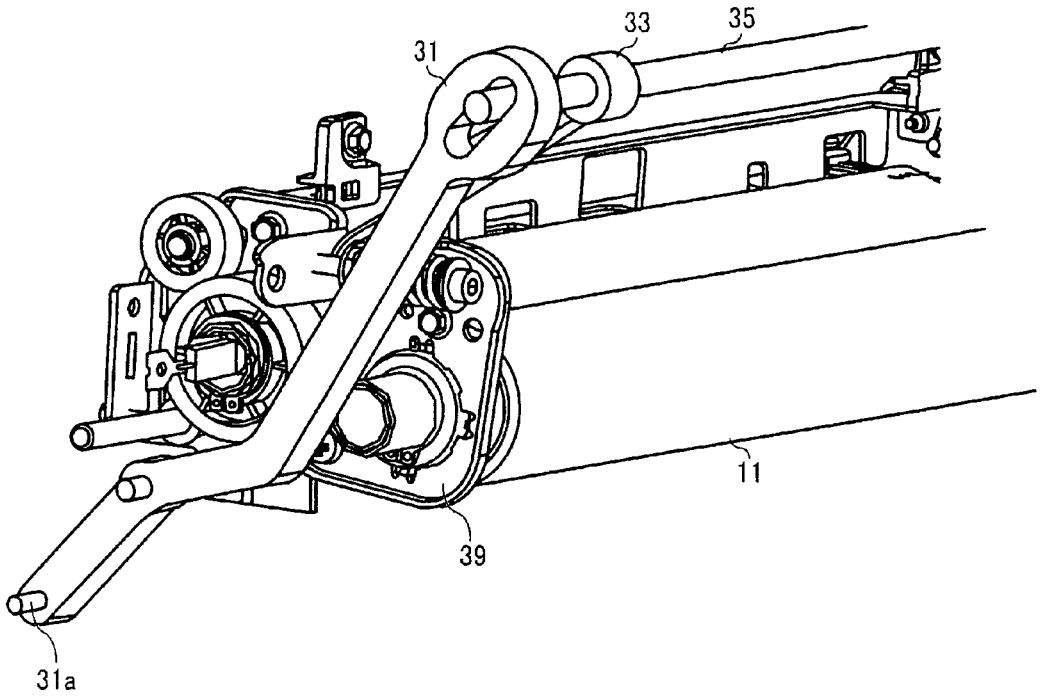
FIG. 11 is a view illustrating the linkage of the power supply switch and the link.
Figure 12:
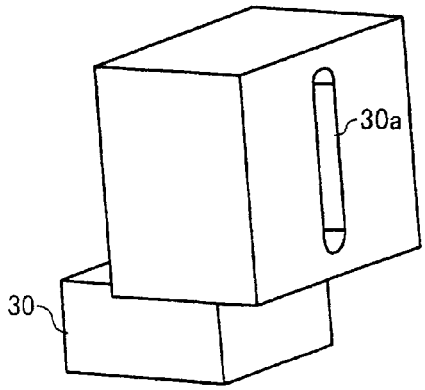
FIG. 12 is another view illustrating the linkage of the power supply switch and the link.

As shown in FIGS. 11 and 12, the power supply switch 30 and the link 31 are connected to each other in a manner such that an axis 31*a* provided on the link is fitted into an elongated hole 30*a* provided on the rear surface of the power supply switch 30. This configuration allows the power supply switch 30 to slide as the link 31 rotates. Although not illustrated, the guide for the sliding motion may be formed as part of the structure of the image forming apparatus.

Figure 5:
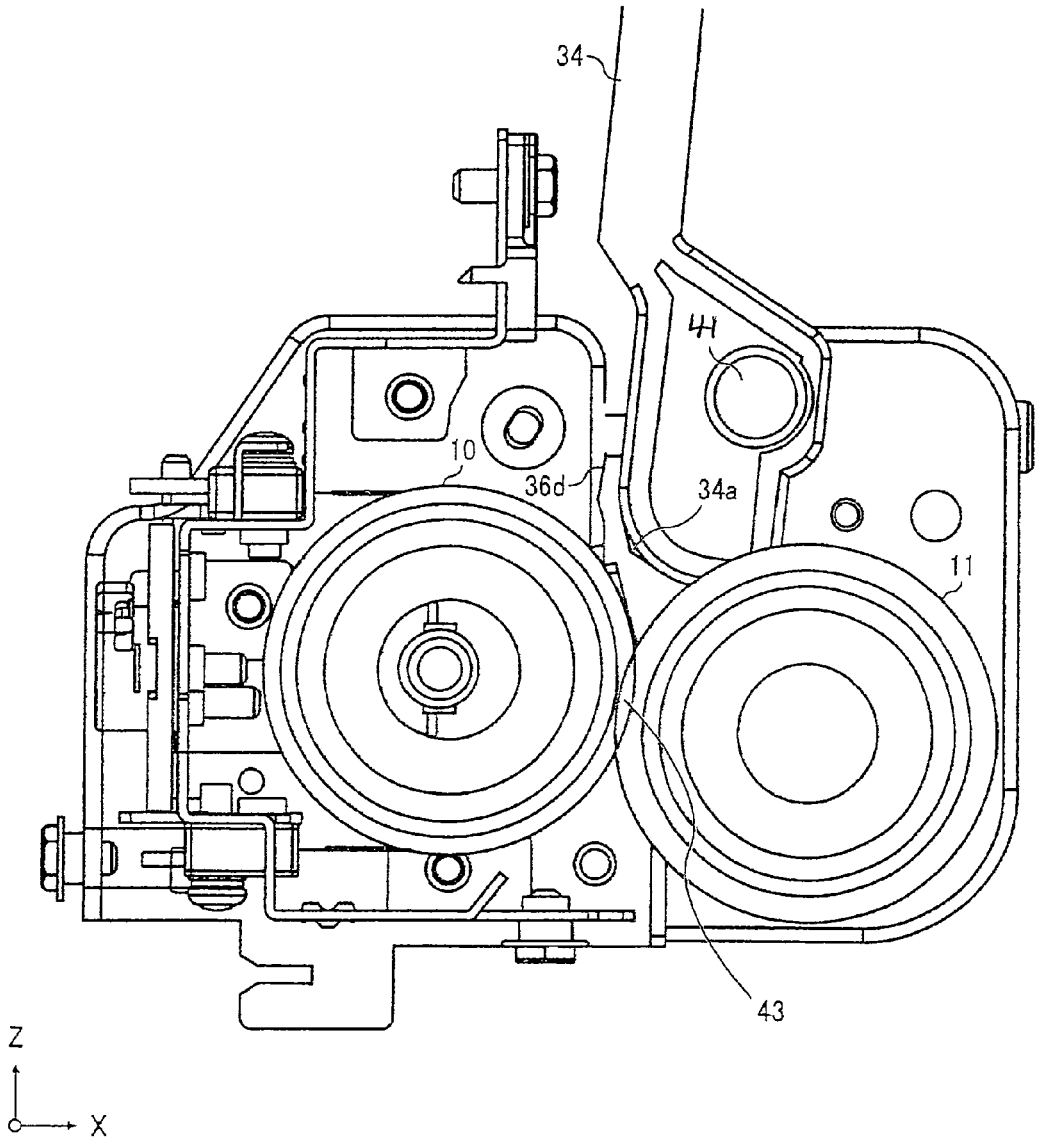
FIG. 5 is a cross-sectional view illustrating the fixing unit in normal service.
Figure 6:
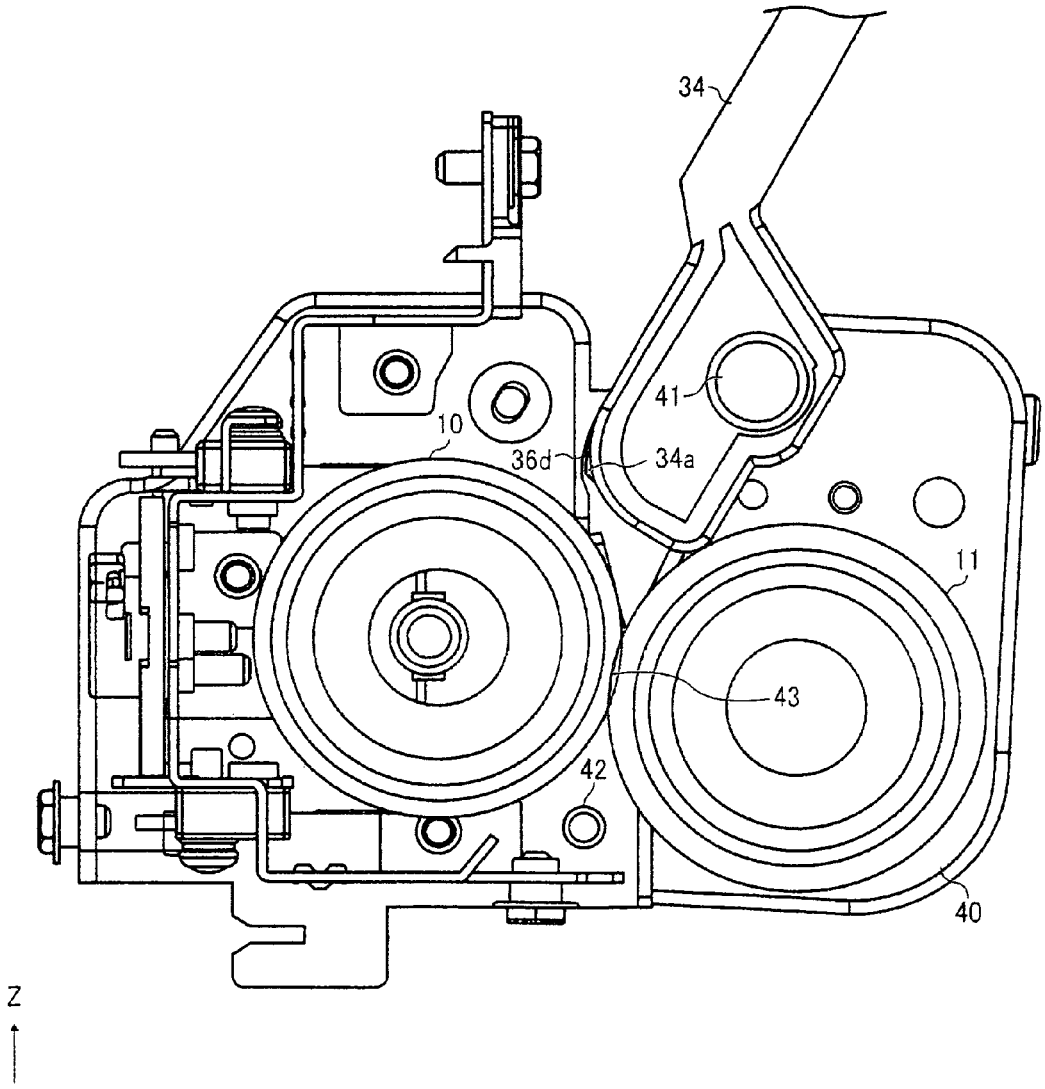
FIG. 6 is a cross-sectional view illustrating the fixing unit with less applied pressure than in normal service conditions.

Now, FIG. 5 is a cross-sectional view illustrating the fixing unit in normal service. In this embodiment, both the fixing roller 10 and the pressing roller 11 have a surface of an elastic material. Under normal conditions, the rollers rotate with the nip portion of the elastic material being flattened to provide sufficient pressure and nip widths. In practice, the nip of a certain width can be found at a contact portion (nip portion) 43 between the rollers in FIG. 5. At this time, the pressure variable members 33 and 34 are not in contact with the fixing-roller side plates 36*a* and 36*b*, so that the applied force by the compression spring acts directly on the pressing roller 11. FIG. 6 also illustrates the fixing unit with a less pressure applied than in normal service conditions. Although depending on the configuration of the fixing roller 10 and the pressing roller 11, the fixing unit may need to operate in this mode mainly to pass special sheets of paper such as envelopes through between the rollers. This mode of operation is also applicable to the fine setting for the optimized quality of image depending on the type of sheets of paper.

Rotating the pressure variable members 33 and 34 causes a portion lower than the rotation fulcrum of the members to serve as a cam, increasing the gap between the pressing-member side plates 39 and 40 and the fixing-roller side plates 36*a* and 36*b*. This allows the pressing-member side plates 39 and 40 to rotate about the rotation fulcrum 42 of the fixing-roller side plates 36*a* and 36*b*, reducing the width of the nip portion 43. At this position, the pressure variable members 33 and 34 come to a standstill by their projection 34*a* being received in a recess 36*d* of the fixing-roller side plates 36*a* and 36*b*. Under this condition, the power supply switch 30 is ON, and the fixing unit enables paper feed operations.

Figure 7:
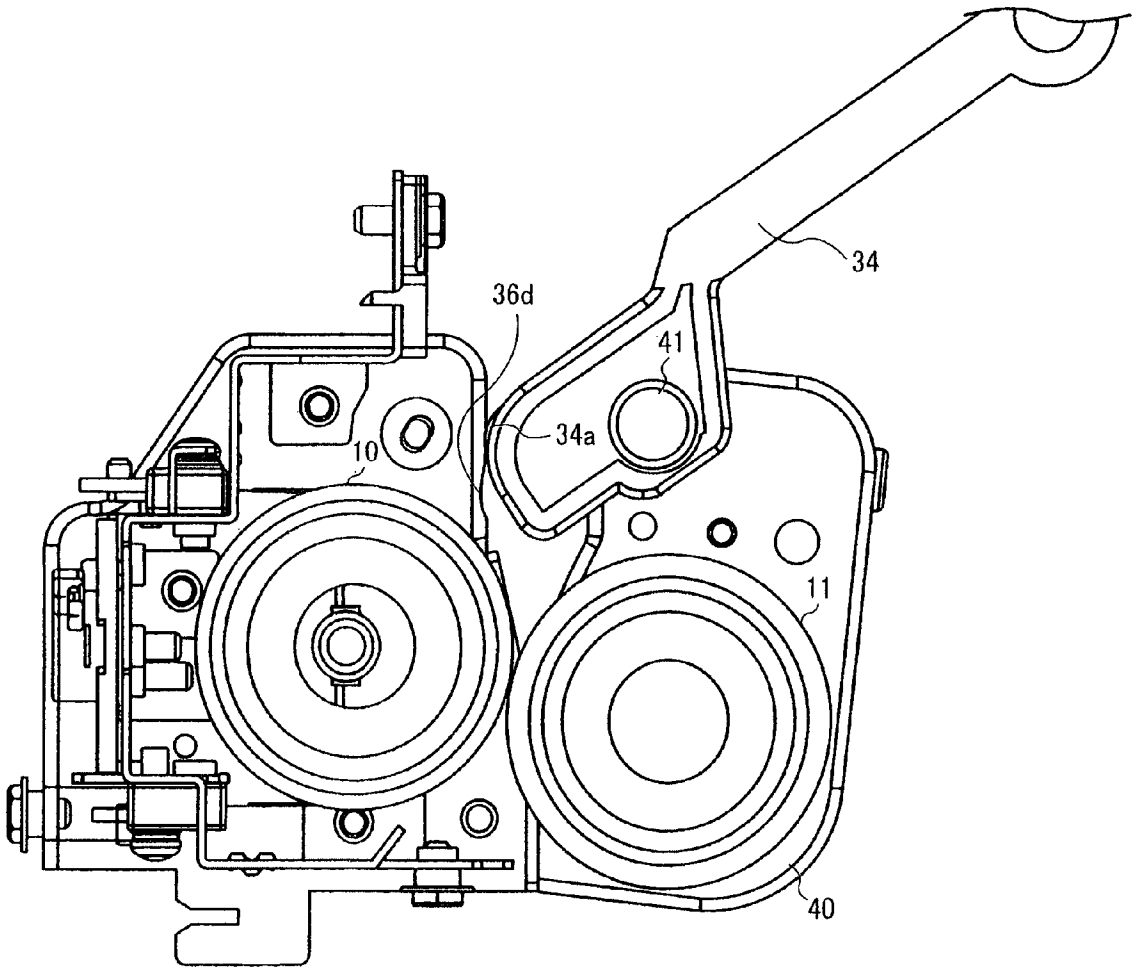
FIG. 7 is a cross-sectional view illustrating a fixing roller and a pressing roller being completely separated from each other.

Now, FIG. 7 illustrates the fixing roller 10 and the pressing roller 11 which are completely separated from each other. At this time, the projection 34*a* of the pressure variable members 33 and 34 has gone beyond the recess 36*d* to come into static contact with a flat portion. Under this condition, the power supply switch 30 of the image forming apparatus is in an OFF state, and the various devices in the image forming apparatus are not working.

Figure 8:
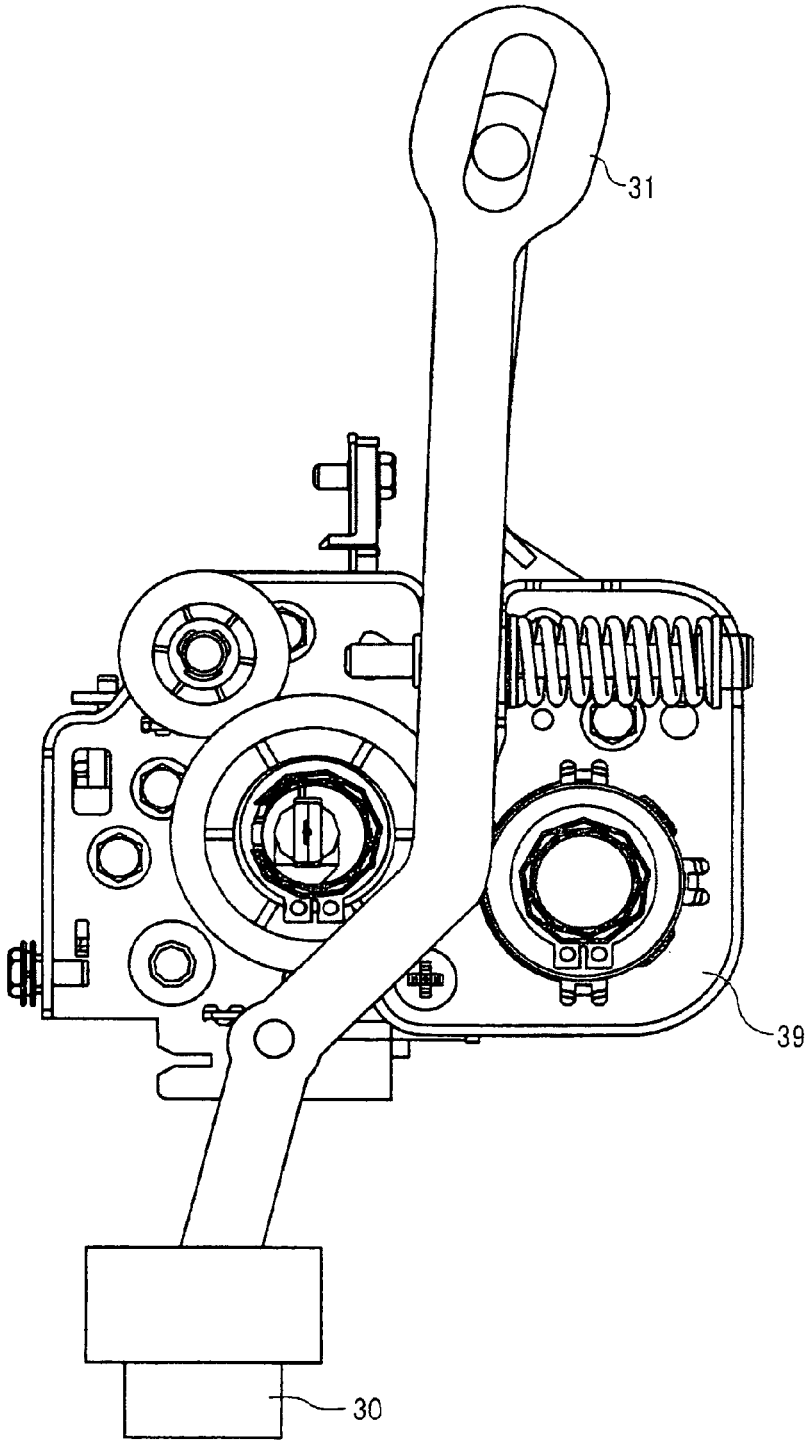
FIG. 8 is a view illustrating a status of a pressure variable member and a status of a link and a power supply switch.
Figure 9:
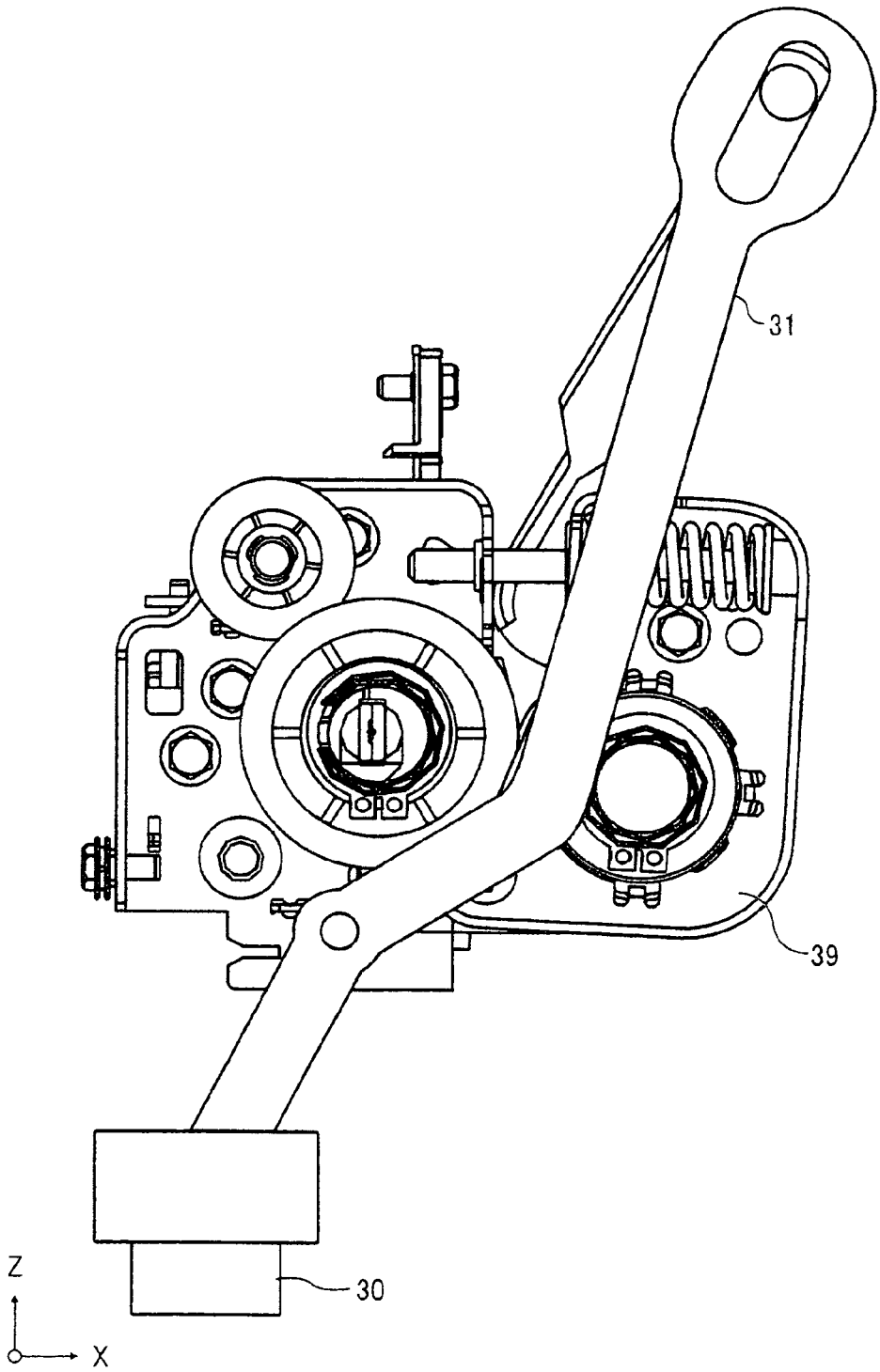
FIG. 9 is a view illustrating another status of the pressure variable member and another status of the link and the power supply switch.
Figure 10:
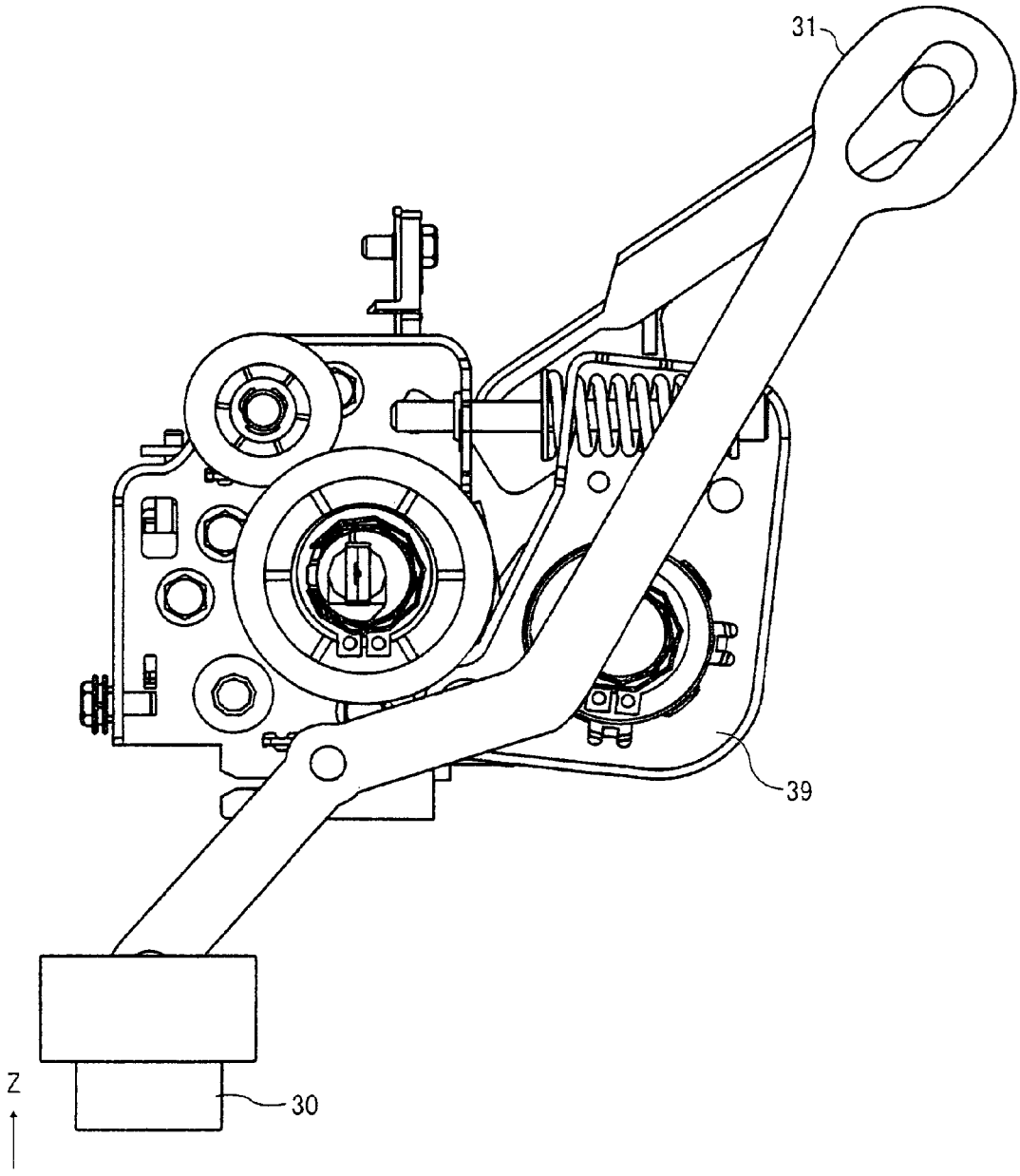
FIG. 10 is a view illustrating still another status of the pressure variable member and still another status of the link and the power supply switch.

FIGS. 8 to 10 illustrate how the pressure variable members 33 and 34, the link 31, and the power supply switch 30 operate together. The power supply switch 30 comes to a standstill at each of three positions. The status of each of these positions can be indicated on the cover of the main body of the image forming apparatus, thereby allowing the user to recognize them. These indications may be provided at the position of the switch, for example, in the form of "Power supply OFF/Power supply ON Envelope mode/Power supply ON Normal mode." Suppose that the power supply switch of such an image forming apparatus as configured in this manner is turned OFF. In this case, this switch operation causes the pressure variable members 33 and 34 to rotate in a cooperative relationship therewith, thereby separating the fixing roller 10 and the pressing roller 11 from each other as illustrated. This ensures, for example, prior to a long out-of-service period, the disengagement of the pressure contact between the fixing roller 10 and the pressing roller 11 without the intervention of the user, thereby preventing permanent deformation of the rollers 10 and 11. Furthermore, this arrangement can be realized by a combination of simple parts without the necessity of any driving sources, thus preventing increases in costs. It should be noted that this embodiment is directed to a fixing unit; however, it can also be applied to various paper feed sections in the image forming apparatus which employ a pair of rollers such as the transfer roller and the feed roller.

The present invention makes it possible to prevent a pair of rollers made of an elastic material from being permanently deformed even when an apparatus equipped with the rollers is not used for a long time.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper feeder assembly for an image forming apparatus, the paper feeder assembly being configured to sandwich a sheet of paper between a roller and an opposing pressing member and to feed the sheet of paper by the roller being rotated, the paper feeder assembly comprising:

a pressure variable member configured to vary pressurized contact force between the roller and the pressing member;

wherein based on a mechanical linkage between the pressure variable member and a power supply switch provided in a main body of the image forming apparatus, the pressure variable member is configured to generate pressure between the roller and the pressing member to ensure pressurized contact between the roller and the pressing member when the power supply switch is turned on, wherein based on the mechanical linkage between the pressure variable member and the power supply switch provided in the main body of the image forming apparatus, the pressure variable member is configured to separate the roller and the pressing member from each other when the power supply switch is turned off, wherein the roller is configured to rotate about a first axis, wherein the pressing member is configured to rotate about a second axis, wherein the first and second axes define a segment of a first plane between the first and second axes, and wherein the pressure variable member is configured to rotate about a first fulcrum disposed in a second plane that perpendicularly intersects the segment of the first plane.

2. The paper feeder assembly according to claim 1, further comprising:

a biasing unit configured to apply biasing force to the roller and the pressing member;

wherein at least one of the roller and the pressing member has a surface of an elastic material, and wherein the pressure variable member is configured to vary a distance between the first and second axes, thereby changing the pressurized contact force.

3. The paper feeder assembly according to claim 1, further comprising:

a biasing unit for applying biasing force to the roller and the pressing member;

wherein at least one of the roller and the pressing member has a surface of an elastic material, and wherein the pressure variable member is partially formed in a cam shape and is configured to rotate about a rotation fulcrum to vary a distance between the first and second axes, thereby changing the pressurized contact force.

4. A fixing unit configured to use the paper feeder assembly according to claim 1, and configured to apply heat and pressure to thereby fix an image on the sheet of paper.

5. The image forming apparatus configured to use the fixing unit according to claim 4.

6. The image forming apparatus configured to use the paper feeder assembly according to claim 1.

7. The paper feeder assembly according to claim 1, wherein the roller is configured to rotate relative to roller side plates about the first axis, wherein the pressing member is configured to rotate relative to pressing member side plates about the second axis, wherein each of the roller side plates is configured to pivot about a second fulcrum relative to a respective one of the pressing member side plates, wherein the first and second fulcrums define a segment of a third plane between the first and second fulcrums, and wherein the segment of the first plane intersects the segment of the third plane.

8. A paper feeder assembly for an image forming apparatus, the paper feeder assembly being configured to sandwich a sheet of paper between a roller and an opposing pressing member and to feed the sheet of paper by the roller being rotated, the paper feeder assembly comprising:

a pressure variable member configured to vary pressurized contact force between the roller and the pressing member;

wherein the pressure variable member is configured to vary the pressurized contact force based on a mechanical linkage between the pressure variable member and a power supply switch provided in a main body of the image forming apparatus, wherein the power supply switch has at least one power supply OFF position and at least one power supply ON position, allowing the pressurized contact force to be adjusted in a plurality of steps depending on a respective position of the power supply switch, wherein the pressure variable member is further configured to generate pressure between the roller and the pressing member to ensure pressurized contact between the roller and the pressing member when the power supply switch is in the at least one power supply ON position, wherein the roller is configured to rotate about a first axis, wherein the pressing member is configured to rotate about a second axis, wherein the first and second axes define a segment of a first plane between the first and second axes, and wherein the pressure variable member is configured to rotate about a first fulcrum disposed in a second plane that perpendicularly intersects the segment of the first plane.

9. The paper feeder assembly according to claim 8, further comprising:

a biasing unit configured to apply biasing force to the roller and the pressing member;

wherein at least one of the roller and the pressing member has a surface of an elastic material, and wherein the pressure variable member is configured to vary a distance between the first and second axes, thereby changing the pressurized contact force.

10. The paper feeder assembly according to claim 8, further comprising:

a biasing unit configured to apply biasing force to the roller and the pressing member;

wherein at least one of the roller and the pressing member has a surface of an elastic material, and wherein the pressure variable member is partially formed in a cam shape and is configured to rotate about the first fulcrum to vary a distance between the first and second axes, thereby changing the pressurized contact force.

11. A fixing unit configured to use the paper feeder assembly according to claim 8, and configured to apply heat and pressure to thereby fix an image on the sheet of paper.

12. The image forming apparatus configured to use the fixing unit according to claim 11.

13. The image forming apparatus configured to use the paper feeder assembly according to claim 8.

14. A paper feeder assembly for an image forming apparatus, the paper feeder assembly being configured to sandwich a sheet of paper between a roller and an opposing pressing member and to feed the sheet of paper by the roller being rotated, the paper feeder assembly comprising:

a pressure variable member configured to vary pressurized contact force between the roller and the pressing member;

wherein based on a mechanical linkage between the pressure variable member and a power supply switch provided in a main body of the image forming apparatus, the pressure variable member is configured to generate pressure between the roller and the pressing member to ensure pressurized contact between the roller and the pressing member when the power supply switch is turned on, wherein based on the mechanical linkage between the pressure variable member and the power supply switch provided in the main body of the image forming apparatus, the pressure variable member is configured to operate to separate the roller and the pressing member from each other when the power supply switch is turned off, wherein the roller is configured to rotate relative to roller side plates, wherein the pressing member is configured to rotate relative to pressing member side plates, and wherein each of the roller side plates is configured to pivot about a second fulcrum relative to a respective one of the pressing member side plates.

15. The paper feeder assembly according to claim 14, wherein each of the roller side plates is biased to pivot toward the respective one of the pressing member side plates.

16. The paper feeder assembly according to claim 14, wherein each of the roller side plates is biased to pivot toward the respective one of the pressing member side plates by a force provided by a spring.

17. The paper feeder assembly according to claim 16, wherein the force provided by the spring is adjustable.

18. The paper feeder assembly according to claim 14, wherein each of the roller side plates is biased to pivot toward the respective one of the pressing member side plates by a compression spring arrangement.

19. The paper feeder assembly according to claim 18, wherein the compression spring arrangement is adjustable.

20. A paper feeder assembly for an image forming apparatus, the paper feeder assembly being configured to sandwich a sheet of paper between a roller and an opposing pressing member and to feed the sheet of paper by the roller being rotated, the paper feeder assembly comprising:

a pressure variable member configured to vary pressurized contact force between the roller and the pressing member;

wherein the pressure variable member is configured to vary the pressurized contact force based on a mechanical linkage between the pressure variable member and a power supply switch provided in a main body of the image forming apparatus, wherein the power supply switch has at least one power supply OFF position and at least one power supply ON position, allowing the pressurized contact force to be adjusted in a plurality of steps depending on a respective position of the power supply switch, wherein the pressure variable member is further configured to generate pressure between the roller and the pressing member to ensure pressurized contact between the roller and the pressing member when the power supply switch is in the at least one power supply ON position, wherein the roller is configured to rotate relative to roller side plates, wherein the pressing member is configured to rotate relative to pressing member side plates, and wherein each of the roller side plates is configured to pivot about a second fulcrum relative to a respective one of the pressing member side plates.

* * * * *